US005255808A

United States Patent [19]

Tobler

[11] Patent Number: 5,255,808

[45] Date of Patent: Oct. 26, 1993

[54] FOLDABLE BOTTLE

[75] Inventor: Viktor Tobler, Oberdurnten, Switzerland

[73] Assignee: Supermatic Kunststoff AG, Uster, Switzerland

[21] Appl. No.: 936,003

[22] Filed: Aug. 27, 1992

[51] Int. Cl.[5] ..... B65D 33/02

[52] U.S. Cl. ..... 220/6; 206/218; 215/1 C; 215/11.3; 220/666

[58] Field of Search ..... 220/6, 666; 215/1 C, 215/11.3; 206/218

[56] References Cited

U.S. PATENT DOCUMENTS

| | | | |
|---|---|---|---|
| 3,179,323 | 4/1965 | Miller | 229/14 |
| 3,201,111 | 8/1965 | Afton | 215/1 C |
| 3,340,869 | 9/1967 | Bang | 215/1 C |
| 3,595,441 | 7/1971 | Grosjean | 222/107 |
| 3,810,503 | 5/1974 | Lewis, Jr. et al. | 150/8 |
| 4,158,376 | 6/1979 | Erb | 150/0.5 |
| 4,869,912 | 9/1989 | McCoy et al. | 215/11.3 |
| 5,048,750 | 9/1991 | Tobler | 222/189 |

FOREIGN PATENT DOCUMENTS

| | | |
|---|---|---|
| 408929 | 6/1990 | European Pat. Off. . |
| 1356549 | 4/1963 | France . |
| 865062 | 4/1961 | United Kingdom . |

*Primary Examiner*—Joseph M. Moy

*Attorney, Agent, or Firm*—Oblon, Spivak, McClelland, Maier & Neustadt

[57] ABSTRACT

In a foldable bottle, two lines of the outer surface located opposite one another are provided as folding lines. Each of these folding lines intersects a bead-type lower folding line, running round transversely to the folding line, at a point of intersection, and intersects a bead-type upper folding line, running round transversely to the folding line, at a point of intersection. Below the point of intersection, each folding line branches into two bead-type folding lines which are arranged in a V-shape and continue from the lower portion of the bottle down to the bottom surface. Above the point of intersection, each folding line branches into two bead-type folding lines which are arranged in a V-shape and extend in the upper portion of the bottle up to the top surface. When the outer surface is folded flat between the folding lines to form a two-ply layer, the upper portion an the lower portion can be folded flat simultaneously on the principle of a folding bottom, as with paper bags. Subsequently, the upper and lower portions can be folded over through 90° and placed against the other bottle parts which have been folded flat.

8 Claims, 5 Drawing Sheets

101

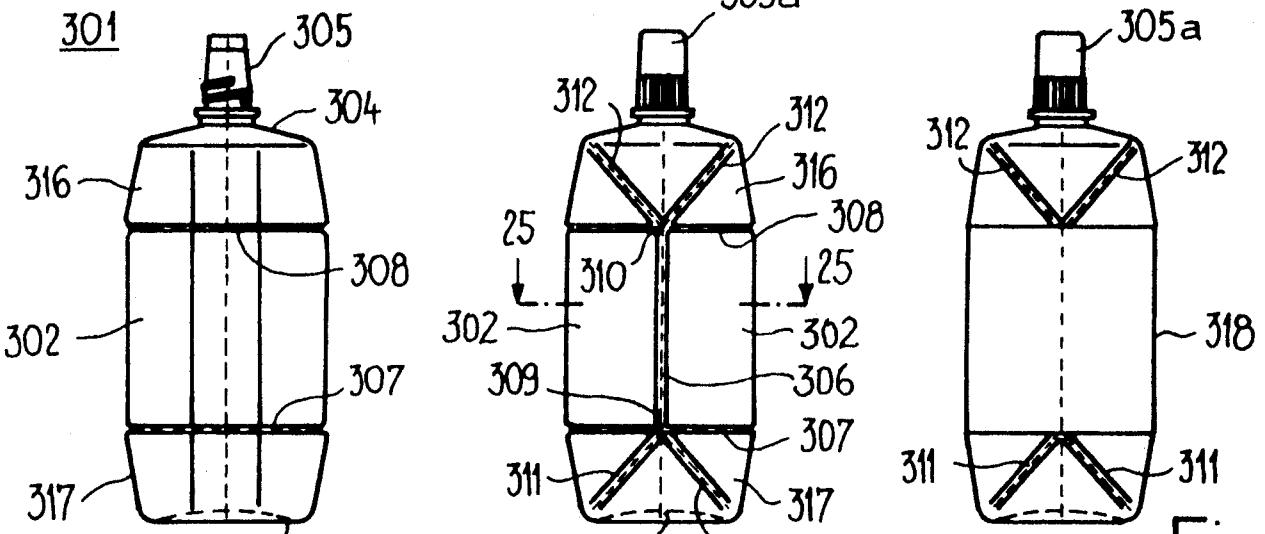
Fig. 21
Fig. 22
Fig. 23
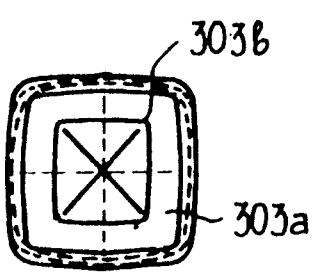
Fig. 26
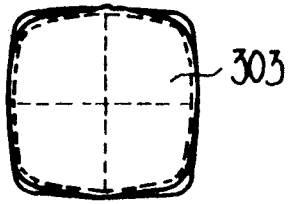
Fig. 25
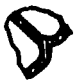
Fig. 27
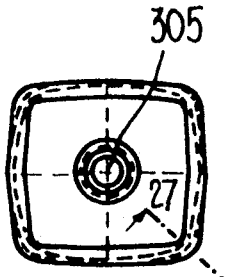
Fig. 24

FOLDABLE BOTTLE

BACKGROUND OF THE INVENTION

1. Field of the Invention

The invention relates to a foldable bottle having a closable pouring part.

2. Discussion of the Background

Known bottles of this type are made, for example, of plastic, if appropriate by blow molding, and serve for containing liquid or granular substances. With a foldable bottle design, it is possible for these bottles to be folded flat in an empty state and therefore take up little space either in waste containers or during transportation to a filling plant for reuse or to a recycling or disposal site.

A foldable bottle of this type, known from EP-A-0,408,929, has an essentially rectangular cross section above its bottom part. Provided in the bottom part is a recess in the form of an inverted V, whose upper edge forms a folding edge which extends horizontally when the bottle is upright. The two ends of this horizontal folding edge coincide in each case with a folding edge which is vertical when the bottle is upright and extends on opposite walls of the bottle so that the empty bottle can be folded into a virtually flat configuration essentially along the three folding edges. The V-type recess merges on both sides in rounded transitions transversely to the horizontal folding edge into two narrow, strip-type standing surfaces parallel to the horizontal folding line and continues into two opposite bottle walls which have no folding edges. By means of this V-type recess, the lowest portion of the bottle is divided into two compartments which only communicate when the level of the contents of the bottle is higher than the upper edge of the recess.

A disadvantage of this bottle consists of the fact that its stability is very poor, specifically for the following reasons: even in the filled state, this bottle does not have a flat bottom surface, but rather only the two parallel strip-type standing surfaces which merge in a rounded manner into the vertical bottle walls; as a result, its stability is reduced. In an almost empty state, it is possible for the bottle contents to be located in only one of the two compartments of the lower portion of the bottle, such that the bottle is very unstable. Due to the V-type recess, the capacity of the bottle is also reduced, with the result being that such bottle must be taller than a bottle of the same capacity with a flat bottom, which likewise has a negative effect on stability.

A further disadvantage of this bottle is to be seen in the fact that, for completely flat folding, the material has to be creased in some places by applying pressure because there are not enough prefabricated folding edges

SUMMARY OF THE INVENTION

The underlying object of the present invention is thus to provide a bottle of the type mentioned at the beginning which has good stability during use in a completely and partially filled state and, in the empty state, can be brought into as flat a form as possible by simple folding without exerting additional pressure.

This object is achieved in a bottle of the type mentioned at the beginning according to the invention by the features of the descriptive part of claim 1. Further designs and preferred exemplary embodiments are defined by the descriptive parts of the dependent patent claims.

The new bottle is distinguished by good stability in both the full and in the empty state as it has a large standing surface because at least the outer edge region of the bottom surface serves as a standing surface. The bottom surface is flat or very slightly curved upward or inward in its central zone so that the new bottle is not taller in comparison to another bottle of the same capacity, which likewise contributes to its stability. It can also easily be folded into a flat form insofar as a lower bottle part comprising the bottom region and an upper bottle part comprising the pouring region can be bent over through 90° along prefabricated folding lines which are horizontal when the bottle is upright, with the result being that they come to rest on the bottle walls which have been folded flat along opposite lines on the outer surface and therefore lie against one another.

BRIEF DESCRIPTION OF THE DRAWINGS

Further details and advantages emerge from the following description and the drawings, in which preferred embodiments of the foldable bottle according to the invention are illustrated purely by way of example.

FIG. 21 shows a first side view of a fourth embodiment of the bottle according to the invention;

FIG. 22 shows a second side view of the bottle illustrated in FIG. 21, this second side view being perpendicular to the first side view in FIG. 21;

FIG. 23 shows the second side view of the bottle illustrated in FIG. 22 with a partial covering;

FIG. 24 shows a top plan view of the bottle illustrated in FIGS. 21—23;

FIG. 25 shows a cross-sectional view of the bottle illustrated in FIGS. 21 to 24 as taken along line 25—25 in FIG. 22;

FIG. 26 shows a bottom view of the bottle illustrated in FIGS. 21 to 25; and

FIG. 27 shows a cross-sectional view of the bottle illustrated in FIGS. 21 to 26 as taken along line 27—27 in FIG. 24.

DESCRIPTION OF THE PREFERRED EMBODIMENTS

Figure 1:
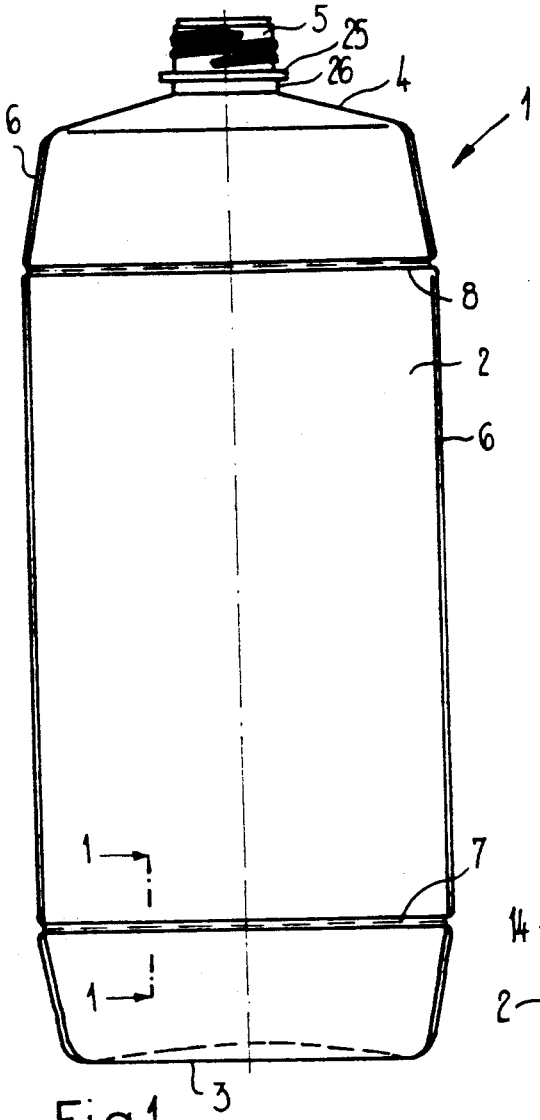
FIG. 1 shows a front elevational view of a first embodiment of the bottle.

According to FIGS. 1 to 8, the first embodiment of the foldable bottle has an essentially rectangular cross section with narrow sides curved slightly outward. The body, 1 of the bottle comprises an outer surface 2 which extends between a bottom surface 3 and an upper top surface 4 with a pouring part 5 arranged thereon. The bottom surface 3 is curved very slightly at its central zone toward the interior of the bottle without the volume of the bottle being substantially diminished as a result. The standing surface which is supported on a base when the bottle is upright is formed by the edge region of the bottom surface. The pouring part 5 is closable by means of a closure (not illustrated in FIG. 1 and FIG. 2), for example a screw closure. On the two narrow sides of the bottle at their center portion, the outer surface 2 has longitudinally extending lines which are located diametrically opposite one another and become folding lines 6 when the outer surface 2 is folded. The folding lines 6 provided on these lines of the outer surface can be of bead-type construction. The folding lines 6 provided each extend between a folding line 7, running round horizontally with spacing from the bottom surface 3, and a folding line 8 running round horizontally with spacing from the top surface 4. The folding lines 7 and 8 thus run transversely to the folding lines 6 and intersect them. From a lower point 9 of intersection and an upper point 10 of intersection, like a continuation of the folding lines 6, but branching in a V-shape, further bead-type folding lines 11 adjoin the folding lines 6 in the lower portion of the bottle and further bead-type folding lines 12 adjoin the folding lines 6 in the upper portion of the bottle. These folding lines and 12, together with the transversely or horizontally running folding lines 8 or 9 of bead-type construction, form an angle of 45° in the present exemplary embodiment, but can also take on different values.

Figure 4:
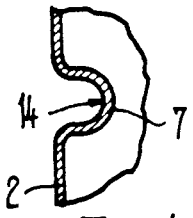
FIG. 4 shows a cross-sectional view of the bottle illustrated in FIGS. 1 to 3 as taken along line 4—4 in FIG. 1.
Figure 2:
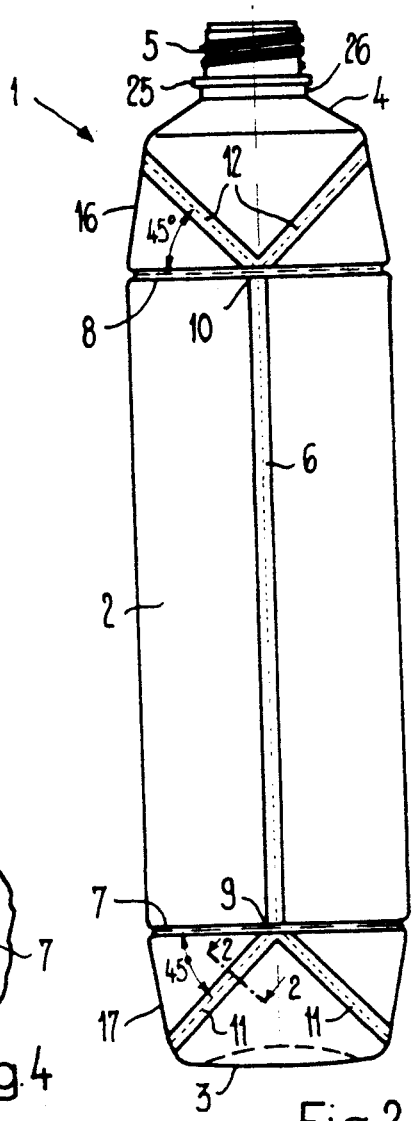
FIG. 2 shows a side view of the bottle illustrated in FIG. 1.
Figure 3:
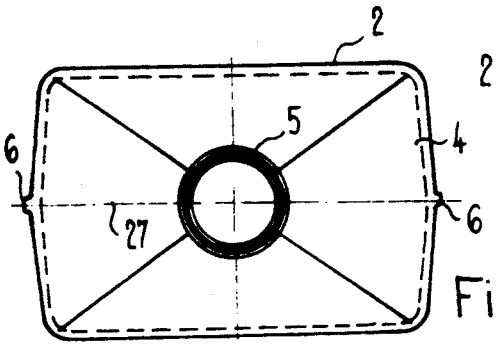
FIG. 3 shows a top plan view of the bottle illustrated in FIGS. 1 and 2.
Figure 5:
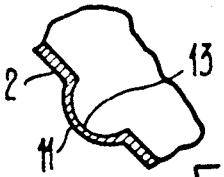
FIG. 5 shows cross-sectional view of the bottle illustrated in FIGS. 1–4 as taken along line 5—5 in FIG. 2.

The cross section illustrated as an extract in FIG. 4 through the outer surface along the line 5—5 in FIG. 2 shows the form of one of the folding lines 11 which is formed by a bead 13 curving outward in a bow shape. The wall thickness is slightly reduced in the central region of the bead 13. The design of this folding line 11 is such that it has the tendency to yield outwardly when the bottle is folded or folded flat. The folding lines 13 in the upper portion of the bottle and, if appropriate, the folding lines 6 in the central portion are constructed in the same manner.

In contrast to the folding lines 6, and 12, the transversely running folding lines 7 and 8 have a tendency to yield inwardly when the bottle is folded, i.e. when the portions of the bottle bounded by said folding lines are folded over. In FIG. 4, the folding line 7 is illustrated on a larger scale in a cross sectional view through the outer surface along the line 4—4 in FIG. 1. The folding line 7 is formed by a bead 14 curved inward in a bow shape. The wall thickness is slightly reduced in the transition regions from the bead 14 to the adjoining outer surface.

Figure 7:
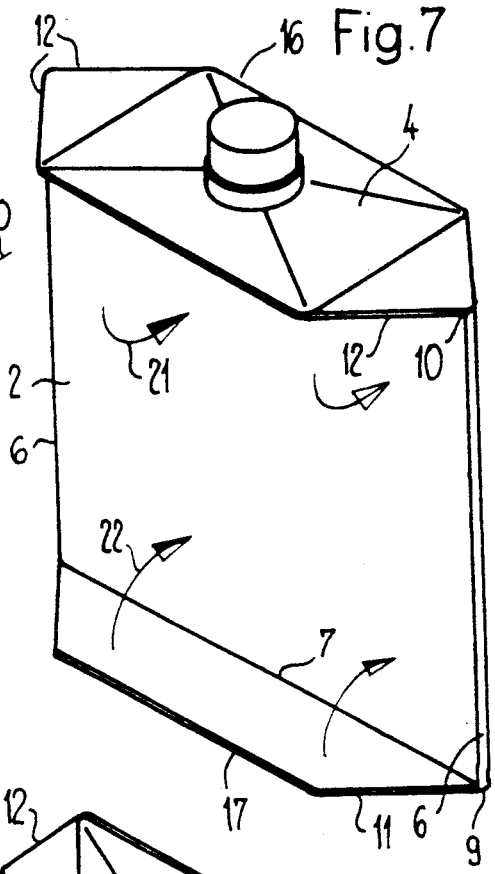
FIG. 7 shows the bottle illustrated in FIGS. 1–6 after a first stage of the folding operation.
Figure 8:
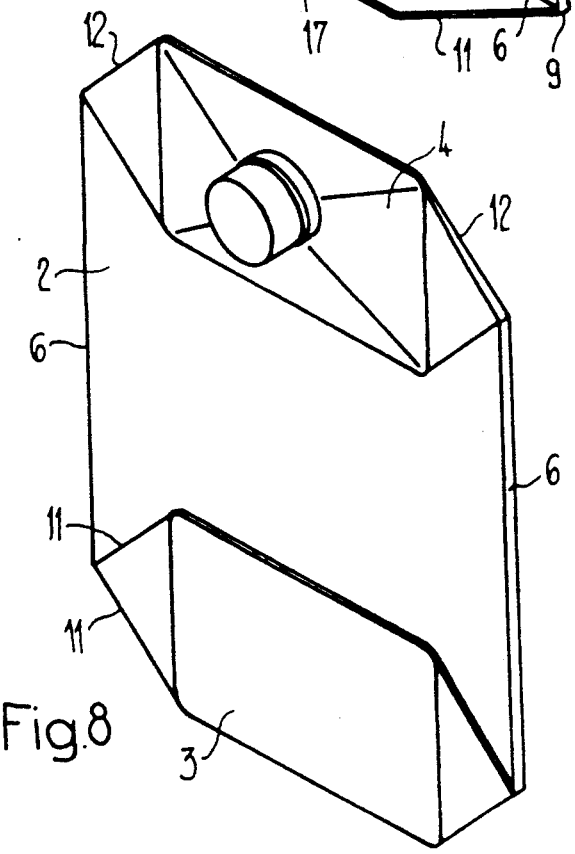
FIG. 8 shows the bottle illustrated in FIGS. 1–7 after complete folding.
Figure 9:
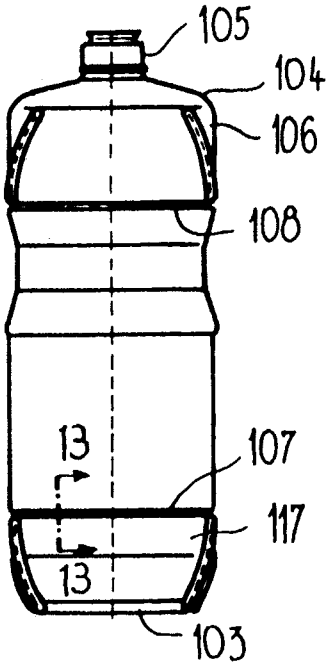
FIG. 9 shows a side view of a second embodiment of the bottle according to the present invention.
Figure 10:
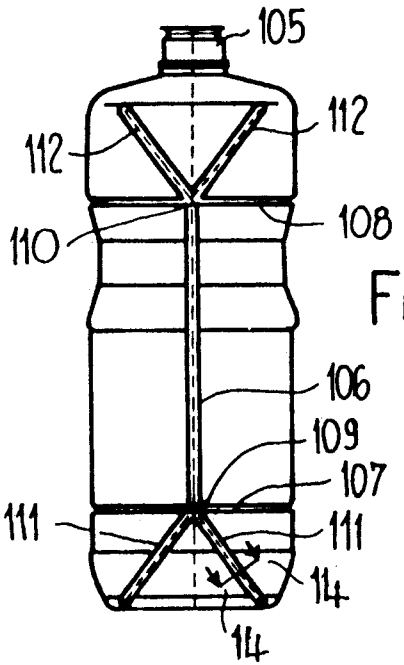
FIG. 10 shows the bottle illustrated in FIG. 9 in a second side view perpendicular to the first side view of FIG. 9.

According to FIGS. 7 and 8, due to the different design of the outwardly yielding folding lines 11 and 12 and, if appropriate lines 6, on the one hand, and the inwardly yielding folding lines 7 and 8 on the other hand, the bottle can be folded flat and an upper portion 16 and a lower portion 17 of the bottle 1 can be folded flat or folded over on the principle of a folding bottom as is known from paper bags.

Figure 6:
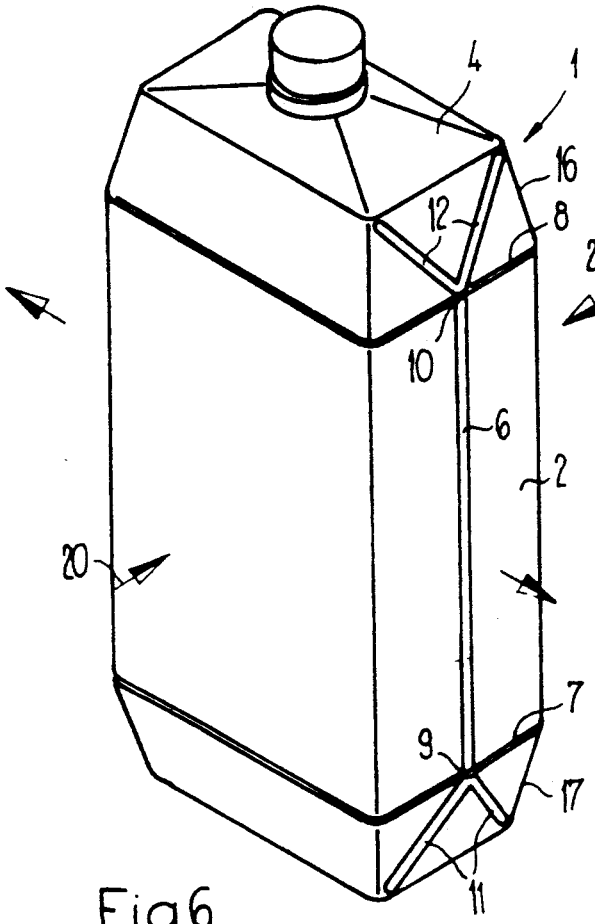
FIG. 6 shows the bottle illustrated in FIGS. 1–5 prior to folding.

When the bottle is folded, in which case it may not be closed, according to arrows 20 in FIG. 6 pressure is exerted on the opposite halves of the bottle 1 which have no folding lines. Additionally, according to FIG. 7, the lower portion 16 and the upper portion 17 are folded flat. As a result of the upper and lower folding lines 11 and 12, directed onto the same line of the outer surface, arranged in a V-shape and of bead-type construction, the outer surface 2 is folded flat along these lines of the outer surface or folding lines 6 connecting the branching points 9 and 10. Subsequently, the portions 16 and 17 can be folded or folded over through 90° according to arrows 21 and 22 in FIG. 7 and, as a result, rest against the outer surface which has been folded flat. Depending on the elasticity of the bottle material used, it may be useful to close the folded bottle again so that it does not automatically unfold again.

On the pouring part 5, below a peripheral collar 25, there is a groove 26 in which retaining means engage during the automatic filling of the bottles in order to guide the bottles at the upper end so that folding of the foldable bottle during the filling operation is ruled out.

During production of such bottles by blow molding, a central, transversely running weld 27 is produced in the top part and in the bottom part. In contrast to the previously known bottles, this weld does not impair the folding properties in the new bottle, which is a further advantage of the bottles according to the present invention.

FIGS. 9 to 14 show another foldable bottle according to the invention. This bottle has an essentially round cross section. Otherwise, in particular with respect of its foldability, it is virtually of the same construction as the bottle illustrated in FIGS. 1 to 8 and described above.

Figure 14:
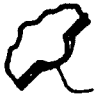
FIG. 14 shows cross-sectional view of the bottle illustrated in FIGS. 9–13 as taken along line 14–14 in FIG. 10.
Figure 12:
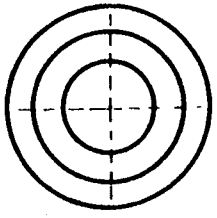
FIG. 12 shows a bottom plan view of bottle illustrated in FIGS. 9 to 11.
Figure 11:
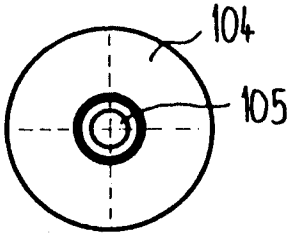
FIG. 11 shows a top plan of the bottle illustrated in FIGS. 9 and 10.
Figure 13:
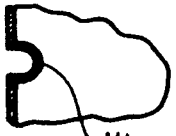
FIG. 13 shows a cross-sectional view of the bottle illustrated in FIGS. 9–12 as taken along line 13—13 in FIG. 9.
Figure 15:
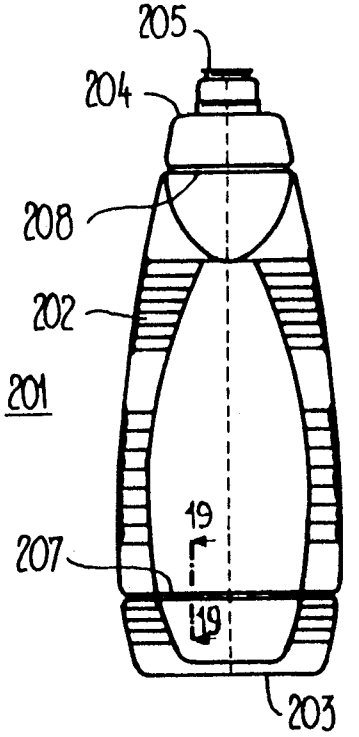
FIG. 15 shows a front view of a third embodiment of the bottle according to the invention.
Figure 16:
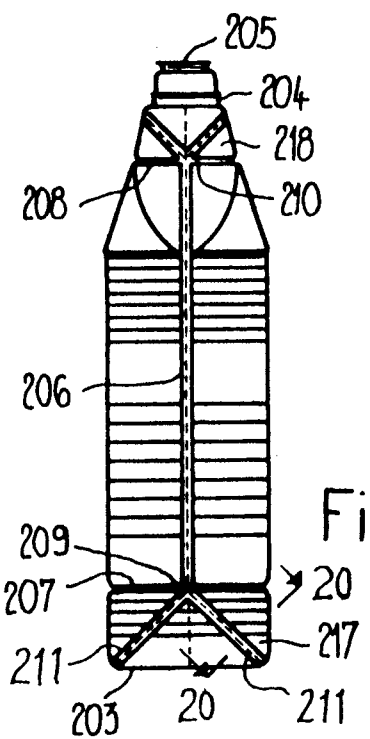
FIG. 16 shows a side view of the bottle illustrated in FIG. 15.
Figure 17:
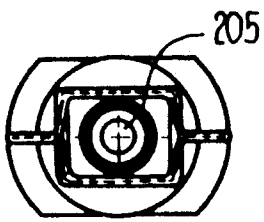
FIG. 17 shows a top plan bottle illustrated in FIGS. 15 and 16.
Figure 18:
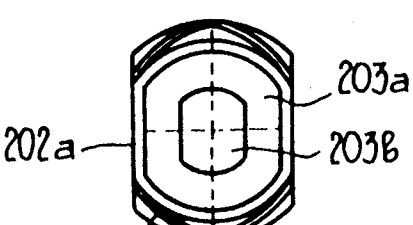
FIG. 18 shows a bottom view of the bottle illustrated in FIGS. 15–17.
Figure 19:
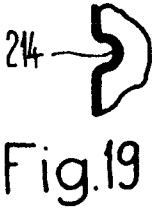
FIG. 19 shows cross-sectional view of the bottle illustrated in FIGS. 15–18 as taken along line 19—19 in FIG. 15.
Figure 20:
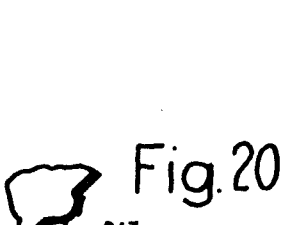
FIG. 20 shows a cross-sectional view of the bottle illustrated in FIGS. 15-19 as along line 20—20 in FIG. 16.

The round bottle has a body 101, an outer surface 102, a flat bottom surface 103 and a top surface 104 on which a pouring part 105 is mounted. Two lines of the outer surface 102 located diametrically opposite each other are provided as folding lines 106. Running transversely thereto are a lower folding line 107 of bead-type Construction and an upper folding line 108 of bead-type construction; the lower folding line 107 bounds a lower portion 117 of the bottle and the upper folding line 100 bounds an upper portion 116 of the bottle. In continuation of each of the folding lines 106, the lower portion 117 of the bottle has two pairs of folding lines 111, starting from a lower point 109 of intersection and arranged in a V-shape, and the upper portion 118 of the bottle has two pairs of folding lines 112 starting from an upper-point 110 of intersection and arranged in a V-shape. FIG. 13 shows a cross section of an inwardly curved bead 114, corresponding to the bead 14 in FIG. 4, which forms the folding lines 107 and 108. FIG. 14 shows a cross section of an outwardly curved bead 113, corresponding to the bead 13 in FIG. 5, as are constructed for the folding lines 111 and 112 and, if appropriate, lines 106.

When this round bottle is folded, the procedure is the same as when the rectangular bottle described above is folded. With the closure open, the bottle is firstly folded flat and, subsequently, the lower portion 111 and the upper portion 112 are folded or folded over in such a way that they rest against the outer surface which has been folded flat.

FIGS. 15 to 20 show a further, similar bottle, in which the central portion has a cross section which is described as rectangular/oval, which means that two opposite sides are formed by flat outer surfaces 202*a* and the two other opposite sides are formed with cylindrical surfaces, e.g. circular-cylindrical surfaces 202*b*.

The bottle has a bottom surface 203 with a standing surface 203*a* and a curved surface 203*b* as well as a top surface 204 with a pouring part 205. On the outer surfaces 202*b*, longitudinally running lines 206 are provided as folding lines 106. Furthermore, two pairs of folding lines 211, arranged in a V-shape, are arranged on the lower portion 217, i.e. below a point 209 of intersection, and two pairs of folding lines 212, arranged in a V-shape, are arranged on the upper portion 218, i.e. above a point 210 of intersection. The lower portion 217 is bounded by a transversely running folding line 207 and the upper portion 216 by a transversely running folding line 208. Likewise in this bottle, the folding lines 207 and 208 are constructed according to FIG. 19 as inwardly, curved beads 214 and the folding lines 211 and 212 as well as the folding lines 206 (which, depending on the material thickness, is not necessary) are constructed according to FIG. 29 as outwardly curved beads 213. Folding of this bottle takes place in an analogous manner to the folding of the bottles already described.

A further bottle is illustrated in FIGS. 21 to 27, whose central portion has a so-called square/round cross section according to FIGS. 24 to 26. This bottle has four outer surfaces 302 curved slightly outward, a bottom surface 303 with a standing surface 303*a* and a curved surface 303*b* as well as a top surface 304 with a threaded pouring part 305 which is closed by a screw cap 305*a* according to FIGS. 22 and 23. This bottle also has longitudinally running folding lines 306 on opposite outer surfaces 302 and, additionally, folding lines 311 arranged on the lower portion 317, i.e. below a point 309 of intersection, and running in a V-shape, and folding lines 312 arranged on the upper portion 316, i.e. above a point 310 of intersection, and running in a V-shape. The lower portion 317 is bounded by a transversely running folding line 307 and the upper portion 316 by a transversely running folding line 308. Essentially, all the folding lines are arranged and constructed in the same manner as those of the bottles already described.

According to FIG. 27, the bottle cross sections of the regions of the central portion adjoining the folding lines are smaller, at least on one part of the circumference, in the corner parts in the present example, than the bottle cross sections of the regions of the lower portion 317 or of the upper portion 316 adjoining the folding lines, with the result being that, in that case, the upper portion 316 and the lower portion 317 project beyond the central portion. This shape is particularly suitable for mounting a label or cover 318 which does not have to be stuck to the bottle and which, if it consists of suitable material, such as cardboard or rigid plastic, can serve as protection and assume a reinforcing function in a given bottle design.

Although this possible design is described in this case with regard to the exemplary embodiment of the bottle illustrated in FIGS. 21 to 27, it can also be used in a corresponding manner in bottles with other cross sections.

Suitable material for the new bottles are plastics, such as polypropylene, polyethylene, PET and PVC, but also metals, such as, for example, aluminum and also composite materials.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A foldable bottle having a closable pouring part, which bottle retains its shape during filling and during removal of the contents, having longitudinally extending folding lines provided in the outer surfaces of the bottle for the purpose of pressing the bottle substantially flat in an empty state, which comprises:

an at least substantially flat bottom surface, at least an edge region of which forms a standing surface;

a top surface having a closable pouring part;

an upper portion which is bounded by a folding line running transversely to the folding lines of the outer surface and which contains the top surface with the pouring part;

a lower portion which is bounded by a folding line running transversely to the folding lines of the outer surface and which contains the bottom surface;

an outer surface which forms a central portion which connects the upper portion to the lower portion and which has an outer surface folding line for the central portion; wherein a first pair of folding lines, each of which include a bead curved outward, are provided which branch substantially in a V-shape for being folded outwardly and extend from the folding line running transversely to the folding lines of the outer surface down to the bottom of the lower portion;

a second pair of folding lines, each of which include a bead curved outwardly, are provided which branch substantially in a V-shape for being folded outwardly and extend from the folding line running transversely to the folding lines of the outer surface up to the top surface of the upper portion; and the first and second pair of folding lines have a branching point thereof in each case on the folding line for the outer surface of the central portion, such that the upper portion and the lower portion as well as the outer surface of the central portion may be folded flat along said folding lines of the outer surface and be folded over into a common plane.

2. The bottle as claimed in claim 1, wherein at least the outer surface of the central portion has a cross sectional shape which is one of a substantially rectangular shape, circular shape, rectangular shape, oval shape, square shape, and round shape, and wherein the lower portion is tapered toward the bottom surface and the upper portion is tapered toward the top surface.

3. The bottle as claimed in claim 1, wherein the outer surface has, spaced from the bottom surface, said lower portion folding line running round parallel to said bottom surface, and, spaced from the top surface, said upper portion folding line running round parallel to the lower portion folding line for folding inward and, in addition, on diametrically opposite lines of the outer surface of the bottle, said longitudinally extending folding line are located so as to be parallel to the mid-axis of the bottle and connect said first folding line to said second folding line.

4. The bottle as claimed in claim 3, wherein the upper and lower portion folding lines portion comprise inwardly curved bow shaped beads for folding inwardly.

5. The bottle as claimed in claim 4, wherein said inwardly curved and outwardly curved beads are symmetrical with respect to a longitudinal central surface thereof, and wherein said beads have a reduced wall thickness in transition regions to one of an adjoining outer surface and a central region of a curve of said beads.

6. The bottle as claimed in claim 1, wherein the outer surface between the upper portion folding line and the lower portion folding line comprises means for folding said outer surface flat in two layers against one another, such that outer surface parts of said upper portion rests against the top surface and outer surface parts of the lower portion rests against the bottom surface simultaneously by folding inward on the upper portion and lower portion folding lines and wherein the upper portion and lower portion, upon having been folded flat, include means for folding folded said upper and lower portions over through 90° onto the outer surface which has been folded flat in two layers in order to form a bottle which is folded completely flat.

7. The bottle as claimed in claim 1, which comprises a pouring part and a peripheral groove located on the pouring part, said groove including means for holding and guiding the bottle during filling for the purpose of preventing collapse of the foldable bottle.

8. The bottle as claimed in patent claim 1, wherein a cross section of a part of the upper portion adjacent to the upper section folding line and a cross section of a part of the lower portion adjacent to the lower section folding line project beyond cross sections of adjacent parts of the central portion, at least on one part of the periphery, so as to form stops for a cover surrounding the central portion.

* * * * *